US008272434B2

(12) United States Patent
Garcia

(10) Patent No.: US 8,272,434 B2
(45) Date of Patent: Sep. 25, 2012

(54) TUBING STRING HANGER AND TENSIONER ASSEMBLY

(75) Inventor: Javier Adolfo Garcia, Edmonton (CA)

(73) Assignee: Robbins & Myers Energy Systems L.P., Willis, TX (US)

( * ) Notice: Subject to any disclaimer, the term of this patent is extended or adjusted under 35 U.S.C. 154(b) by 262 days.

(21) Appl. No.: 12/728,589

(22) Filed: Mar. 22, 2010

(65) Prior Publication Data

US 2011/0226488 A1 Sep. 22, 2011

(51) Int. Cl.
*E21B 19/00* (2006.01)

(52) U.S. Cl. ..... 166/78.1

(58) Field of Classification Search ..... 166/77.51, 166/382, 78.1; 464/163
See application file for complete search history.

(56) References Cited

U.S. PATENT DOCUMENTS

| | | | | |
|---|---|---|---|---|
| 5,139,090 | A | 8/1992 | Land | |
| 5,327,975 | A | 7/1994 | Land | |
| 5,388,639 | A | 2/1995 | Betchan et al. | |
| 5,431,230 | A | 7/1995 | Land et al. | |
| 5,964,286 | A * | 10/1999 | Cuppen | 166/78.1 |
| 6,199,630 | B1 * | 3/2001 | Blundell et al. | 166/78.1 |
| 6,543,533 | B2 | 4/2003 | Meek et al. | |
| 6,695,060 | B1 | 2/2004 | Guidry, Jr. et al. | |
| 6,834,717 | B2 * | 12/2004 | Bland | 166/78.1 |
| 7,448,444 | B2 | 11/2008 | Thomson et al. | |
| 2003/0024709 | A1 * | 2/2003 | Cuppen | 166/382 |
| 2006/0225890 | A1 * | 10/2006 | Ray | 166/382 |

* cited by examiner

*Primary Examiner* — Kenneth L Thompson
(74) *Attorney, Agent, or Firm* — Streets & Steele

(57) ABSTRACT

An apparatus for supporting a rotatable tubing string in a well and for tensioning the tubing string includes a tubing head (12) and inner mandrel (34) positioned at least partially within the tubing head and supporting the tubing string. A bushing (32) is supported on the tubing head and engages the inner mandrel, such that the bushing and the inner mandrel rotate together. A tubing rotator (16) is provided for rotating the bushing, with a tubing rotator having a rotator mandrel connected to the bushing. A plurality of circumferentially spaced J-lock mechanisms (56) between the bushing and the inner mandrel are provided for tensioning the tubing string.

19 Claims, 7 Drawing Sheets

TUBING STRING HANGER AND TENSIONER ASSEMBLY

FIELD OF THE INVENTION

The present invention relates to devices for rotatably hanging a tubing string in a well, and more particularly relates to a tubing hanger with a mechanism for reliably tensioning the tubing string. The tubing hanger tensions the tubing string, and the rotator which rotates the tubing string may be removed while the hanger remains in place.

BACKGROUND OF THE INVENTION

Various types of tubing hangers have been devised for hanging a tubing string in a well. Some tubing hangers are also intended to tension a tubing string, although such tubing hanger designs are frequently limited for use with a specific type of tubing anchor. If the tubing rotator must be pulled from the well for replacement or repair, a majority of devices also require the tubing string to be pulled from the well.

U.S. Pat. No. 5,139,090 discloses a tubing rotator with a downhole tubing swivel and a J-lock mechanism for locking and unlocking the swivel. U.S. Pat. No. 6,543,533 discloses a casing hanger supported on a casing head. U.S. Pat. No. 6,834,717 discloses various designs for a tubing rotator, including designs wherein the tubing hanger is supported from the tubing head.

The disadvantages of the prior art are overcome by the present invention, and an improved apparatus for supporting a rotatable tubing string in a well and for tensioning the tubing string are hereinafter disclosed.

SUMMARY OF THE INVENTION

In one embodiment, an assembly for supporting a rotatable tubing string in a well and for tensioning the tubing string includes a tubing head having at least one side port therein, an inner mandrel positioned at least partially within the tubing head and supporting the tubing string, and a bushing supported on the tubing head and engaging the inner mandrel, with the bushing and inner mandrel being rotatable together relative to the tubing head. The assembly includes a tubing rotator for rotating the bushing, with the tubing rotator having a rotatable mandrel rotatably connected to the bushing. The tubing rotator is removable from the bushing and the tubing head while the bushing supports the tubing string. Circumferentially spaced J-lock mechanisms are provided between the bushing and the inner mandrel for tensioning the tubing string.

These and further features and advantages of the present invention will become apparent from the following detailed description, wherein reference is made to the figures in the accompanying drawings.

DETAILED DESCRIPTION OF PREFERRED EMBODIMENTS

Figure 1:
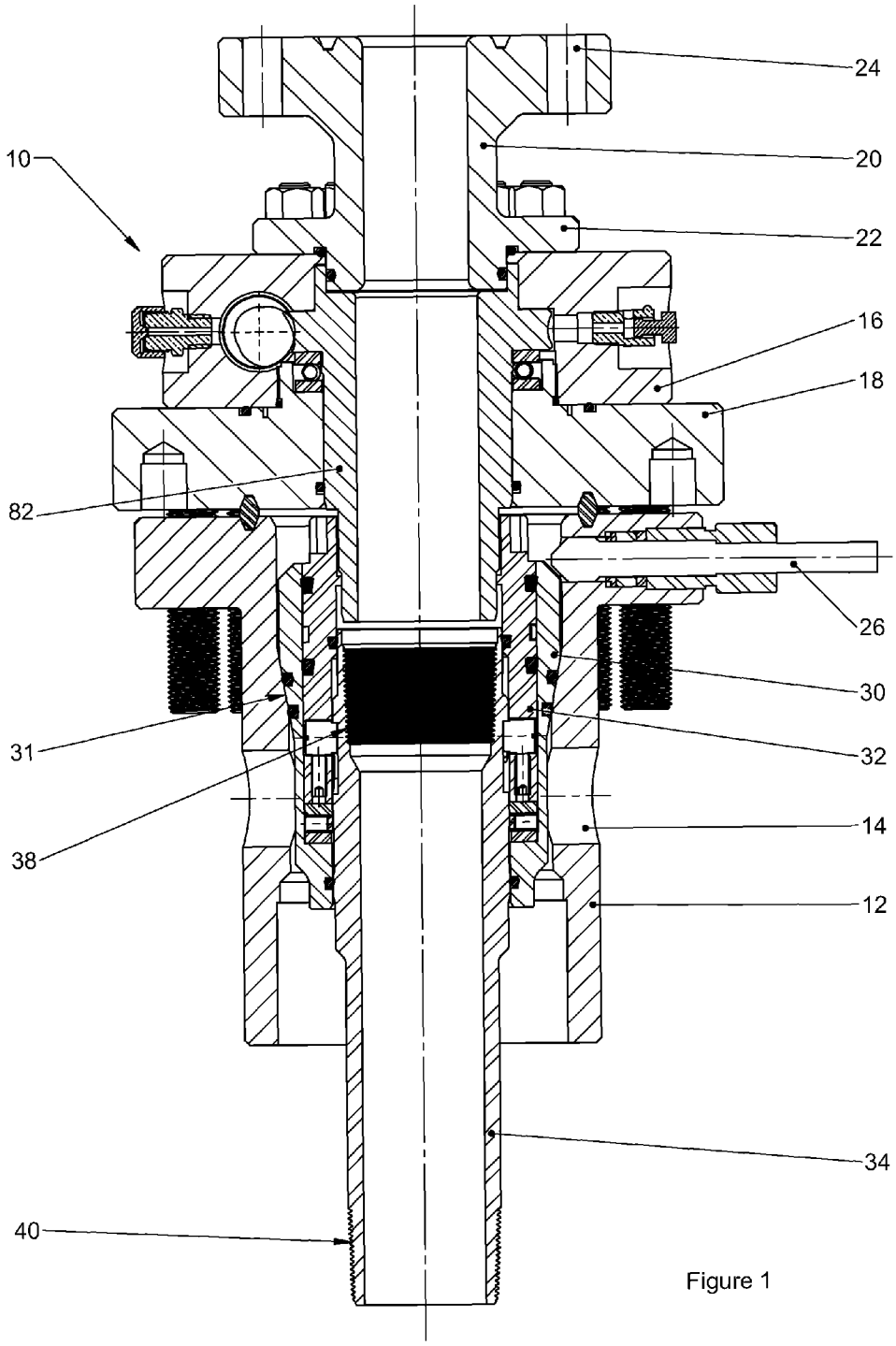
FIG. 1 is a side view, partially a cross-section, of an assembly for rotatably supporting a tubular string in the well for both rotating and tensioning the tubing string.

FIG. 1 depicts one embodiment of assembly 10 according to the present invention for tensioning a tubing string and for rotating the tensioned tubing string. Assembly 10 includes a tubing head 12 for receiving a mandrel 34 which is threadably connected to the tubing string. Wellhead 12 includes at least one, and more commonly two, side ports 14 for discharging fluid from the annulus between mandrel 34 and an outer tubular (not shown) fluidly sealed to the tubing head 12. Tubing head 12 supports an outer head mandrel 30 resting on the tapered shoulder 31 of the tubing head 12, and also a middle mandrel or bushing 32 discussed subsequently. Threads 38 provided at the upper end of the mandrel 34 may be used for tensioning the tubing string, as explained subsequently. One or more lockdown screws 26 of a conventional design may be used to secure the outer mandrel 30 within the tubing head 12 and prevent upward movement of the mandrel 30 in response to high fluid pressure.

FIG. 1 also generally depicts a tubing rotator 16 positioned on lower flange 18, which in turn is connected by bolts to the tubing head. A top flange member 20 includes a lower flange 22 for engagement with the top of the rotator 16, and upper flange 24 for connection to selected components above the tubing rotator, such as tubing tensioning equipment. The tubing rotator 16 may be functionally similar to the rotator shown in FIG. 13 of U.S. Pat. No. 6,834,717.

As explained further below, the assembly as shown in FIG. 1 allows the tubing string to be tensioned before being rotated, with the tubing rotator then rotating the tensioned tubing string. The reverse operation can be used to release tension from the tubing string and thereby disengage the downhole anchor.

There are many applications where it is highly desirable to tension a tubing string, while still being able to rotate the tubing string in the well. In an exemplary application, the tubing string may be subject to a maximum load of 40,000 pounds, with 35,000 pounds remaining as the hanging load once the hanger is set in the tubing head. In some applications, the hanging load may be less than 35,000 pounds, and in other applications the hanging load may be greater than 35,000 pounds.

Figure 2:
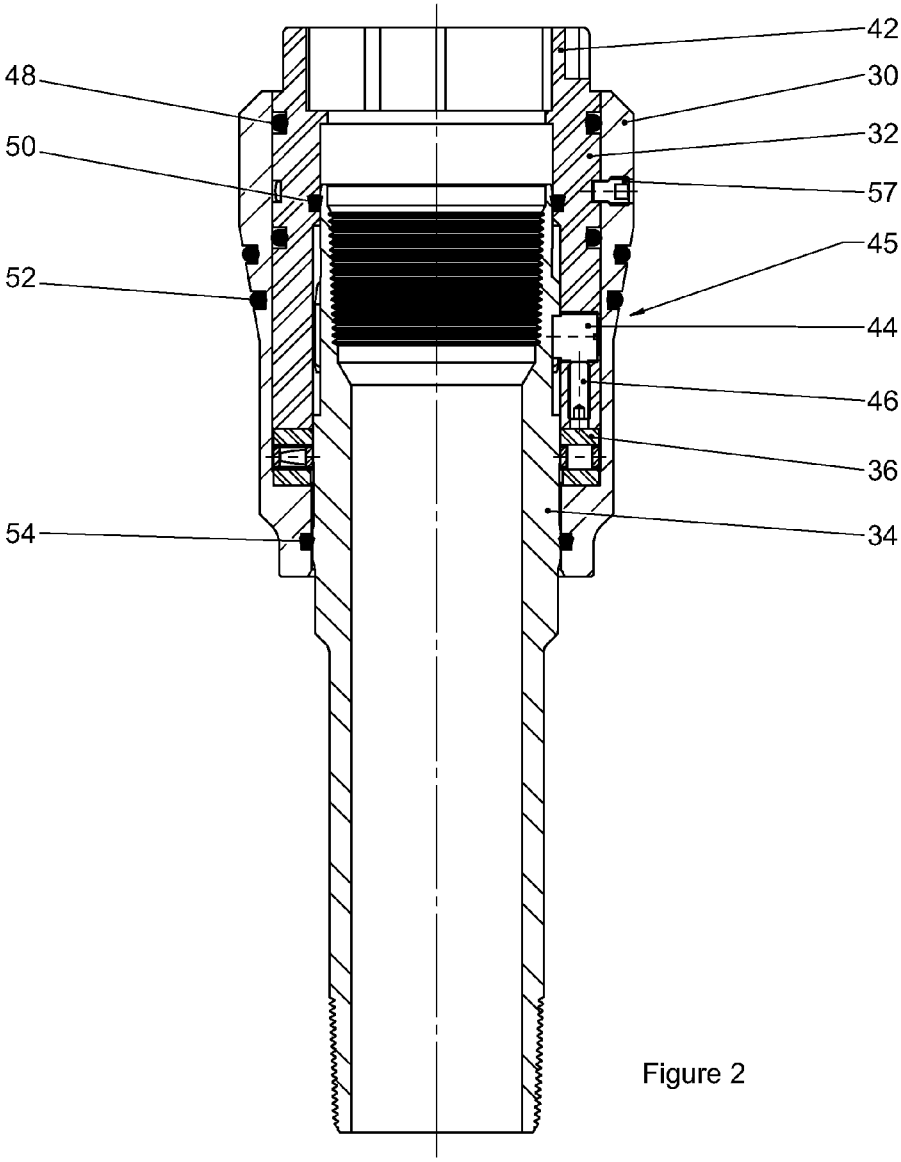
FIG. 2 is a cross-sectional view of the components supported on the tubing head.

Referring more particularly to FIG. 2, the assembly includes a non-rotatable outer head mandrel 30 supported on the tubing head, and a bushing 32 and an inner mandrel 34 each indirectly supported on a tubing head. The bushing and the inner mandrel are rotatable together relative to the tubing head due to the J-lock mechanism discussed subsequently. Thrust bearing 36 is provided to facilitate rotation of the bushing. The inner mandrel 34 travels axially inside the bushing, allowing the setup of the tubing anchor and the subsequent stretching of the tubing string and final connection to the bushing, thereby transmitting the hanging load. The bushing is axially fixed relative to the tubing head 12 and transmits rotation to the tubing string, while the inner mandrel 34 is threaded directly to the tubing string and can travel axially a limited distance, as explained subsequently, relative to the bushing.

Figure 3:
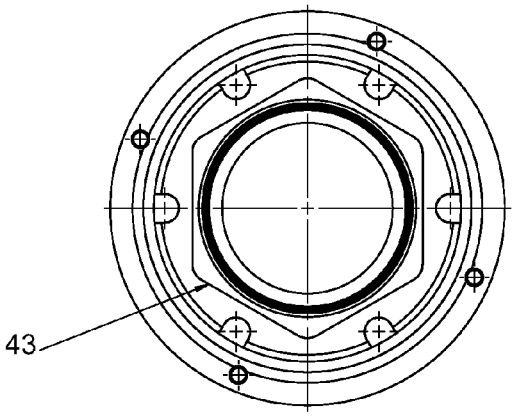
FIG. 3 is a top view on the apparatus showing FIG. 2.

FIGS. 1, 2 and 3 illustrate the connection between the lower end of rotator sleeve 82 and the upper end of bushing 32, which is rotatably connected to the inner mandrel 34. More particularly, the upper end 42 of the bushing 32 as shown in FIGS. 2 and 3 has a hexagonal inner surface, and a mating hexagonal outer surface on the tubing rotator sleeve fits within the upper end of the bushing. Those skilled in the art appreciate that other configurations of non-cylindrical surfaces may be used for rotatably connecting these components, while allowing the rotator 16 including the rotator sleeve 82 to be lifted vertically to disengage from the tubing head 12. FIG. 3 shows the hexagonal surface 43 on the bushing 32 which transmits torque from the rotator 16 to the bushing 32 and then to the inner mandrel 34.

Figure 4:
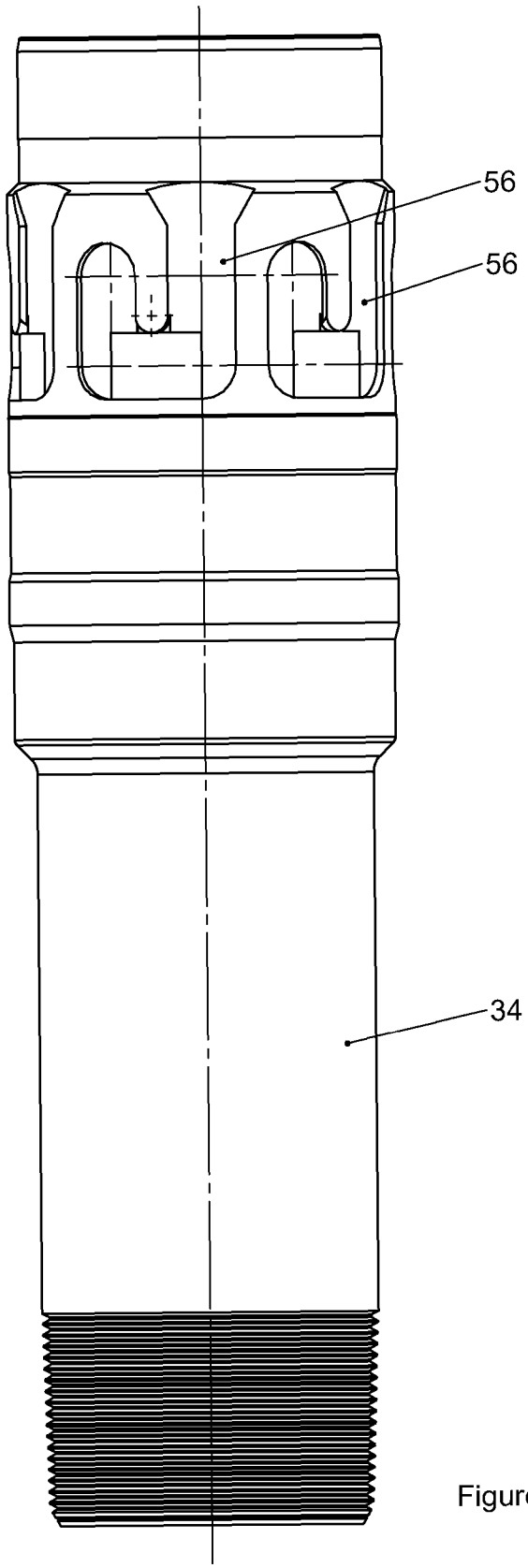
FIG. 4 is a side view of the inner mandrel, showing the J-lock slots.

The bushing and the inner mandrel are rotationally and axially connected by six circumferentially spaced J-lock connections 45. The pins 44 for the J-connections 45 are secured to the bushing 32 which is temporarily held stationary, while the six corresponding J-slots 56 as shown in FIG. 4 are machined on the outside of the inner mandrel. The pins 44 may be threaded to the bushing 32, or may otherwise be secured to the bushing. Set screws 46 lock each of the pins 44 in place. One or more set screws 57 rotate within an annular slot within the bushing and thus axially connect the bushing to the outer mandrel, and thus retain the bushing within the outer mandrel 32 if an upward force is applied to the bushing.

The J-lock mechanisms 45 as disclosed herein have significant advantages over other mechanisms commonly used for connecting components. Threads may be used to stretch a tubing string, but the tubing anchoring and landing operations may require rotating the string to the left or right for anchor release, which is difficult to ensure downhole due to the long stretch of tubing from the surface to the anchor. The present invention may use the J-lock mechanism at the surface, and a controlled amount of rotation may be used to reliably move the pins through the J-slots.

As disclosed herein, the J-lock pins 44 extend radially inward from and are fixed to the bushing 32, and the corresponding J-slots 56 are provided in the inner mandrel 34. By providing J-slots in the inner mandrel, a larger inner mandrel OD may be utilized compared to the alternative of securing the pins to the inner mandrel and providing J-slots in the bushing. If the pins are provided on the inner mandrel, the resultant thickness of the inner mandrel may not be sufficient to hold the pins stable when loaded. Also, the J-slot mechanism may be provided above the annulus sealed area, in which case the pin could extend through the radial thickness of the bushing.

With respect to the J-lock mechanism, the term "pin" as used herein intended to cover not only elongate generally cylindrical pins which commonly fit within slots, but other structurally similar devices which do not have a generally cylindrical configuration and may be termed "fins." Also, the pins or fins may be spring biased so that they move radially to extend into a slot when properly aligned. To release the tubing anchor, the tool may be inserted to retract the pins out of the slots. In other embodiments, the configuration of a slot may be other than a J, and similar pin-slot mechanisms may be termed E-slots, F-slots, G-slots, M-slots, or W-slots.

Figure 8:
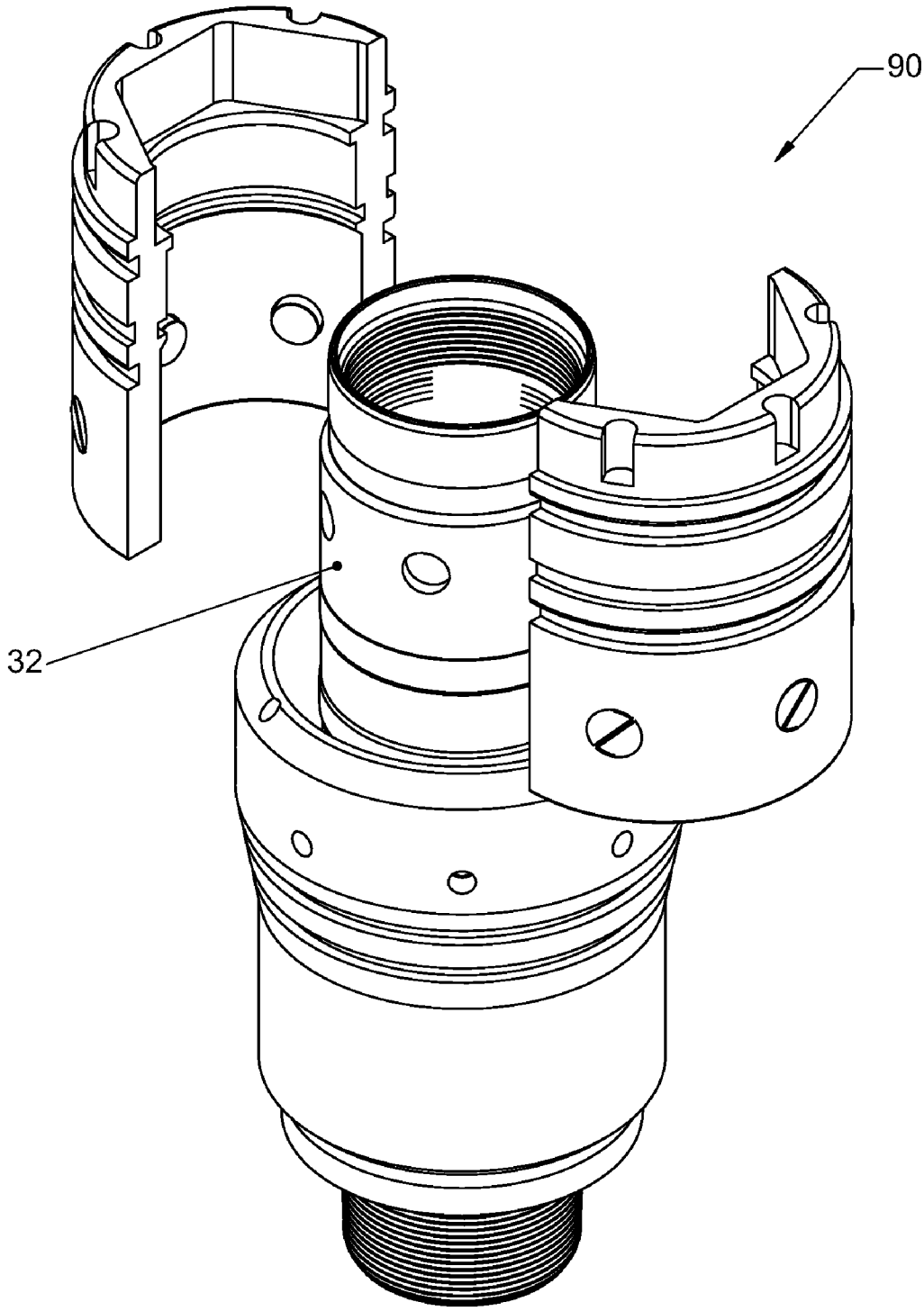
FIG. 8 is an isometric view of a clamping device for holding the tubing in tension.

In yet another embodiment, as shown in FIG. 8, a clamping device 90 may be closed over the inner mandrel 34 after tensioning the tubing. The two-piece clamping device 90 is seated on the bearing 32 transferring the hanging load to the outer mandrel 30. More particularly, the clamping device may be in the form of a bushing with two similar semi-sleeve shaped members closing over the inner mandrel and secured in the closed position by conventional bolts. Pins may be oriented to allow for a reliable clamping action. Seals may be added, and locking features utilized to keep the bearing inside the outer mandrel.

Figure 5:
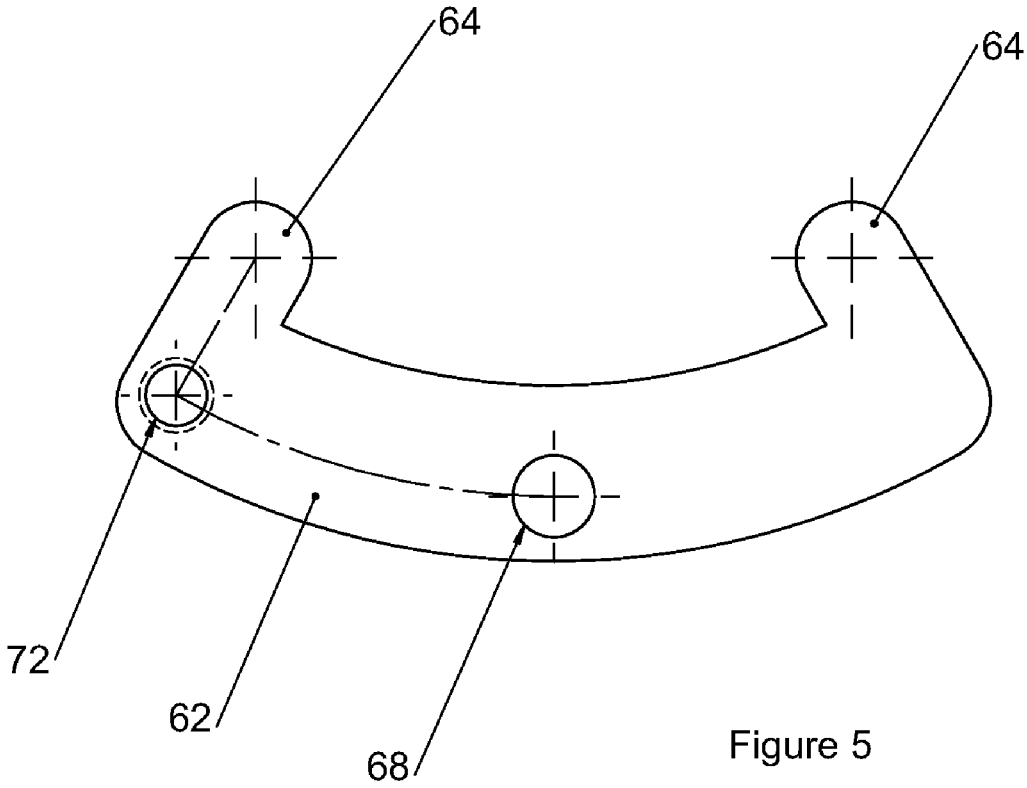
FIG. 5 is a top view of a suitable locking fitting.
Figure 6:
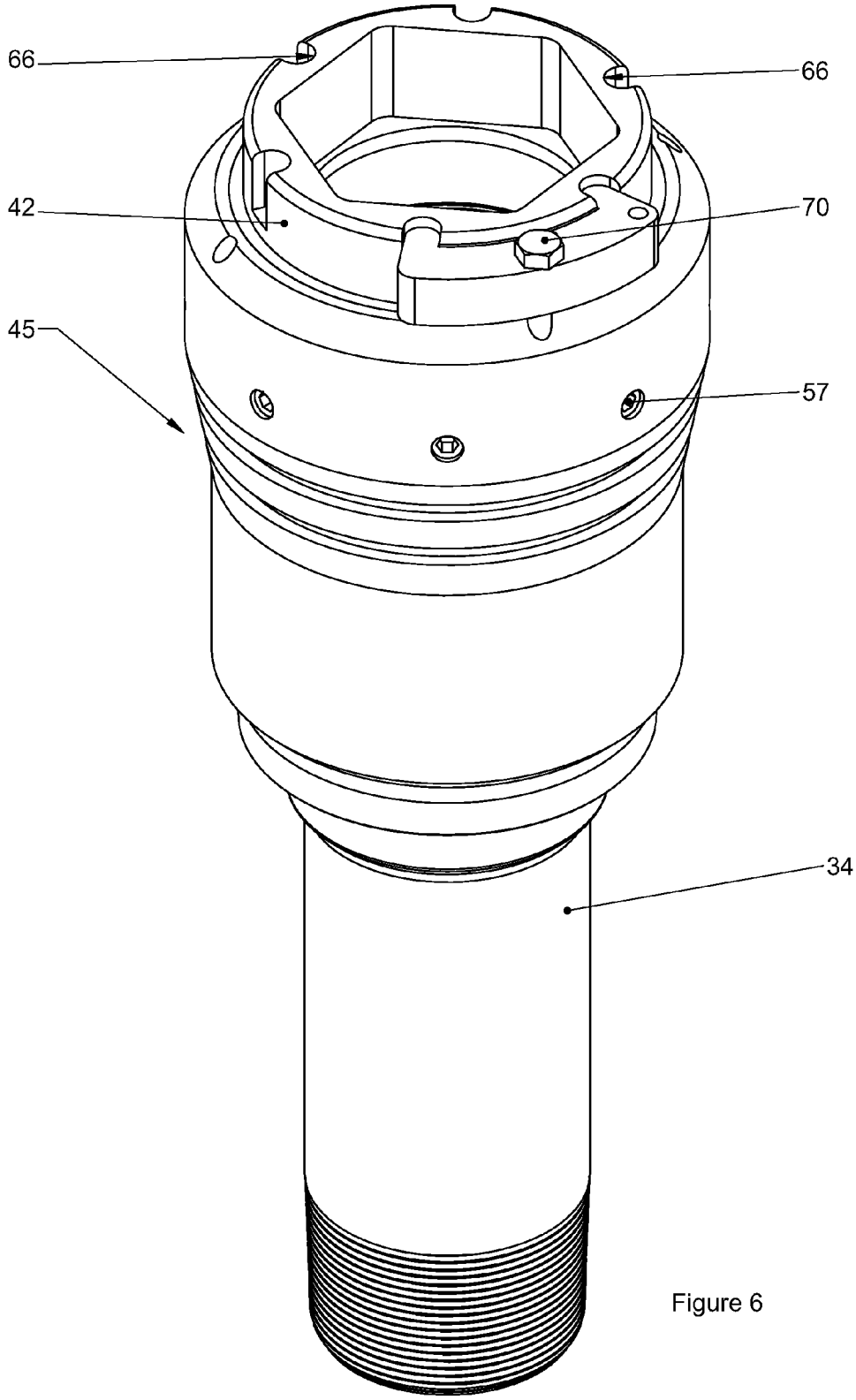
FIG. 6 is an isometric view of a hanger with a locking fitting.

FIG. 5 is a top view of a suitable locking fitting 62 to temporarily prohibit rotation of bushing 32 during manipulation of the J-lock mechanism. Referring to FIGS. 5 and 6, the rotator 16 and flange 18 may be removed, and the locking fitting 62 with a pair of radially inward projecting tabs 64 each fitted within a respective recess 66 in the bushing upper sleeve section 42. Central aperture 68 is provided for receiving a suitable bolt 70 for connecting the locking fitting to the outer head mandrel 30. A particular feature of the invention is that a locking fitting is positioned from above the hanger to serve its locking purpose. Access to the upper surfaces of the hanger will be available when the rotator is removed. A pup joint may then be threaded to threads 38 at the top of mandrel 34 to rotate and axially move the inner mandrel relates to the bushing during manipulation of the J-lock mechanism.

Figure 7:
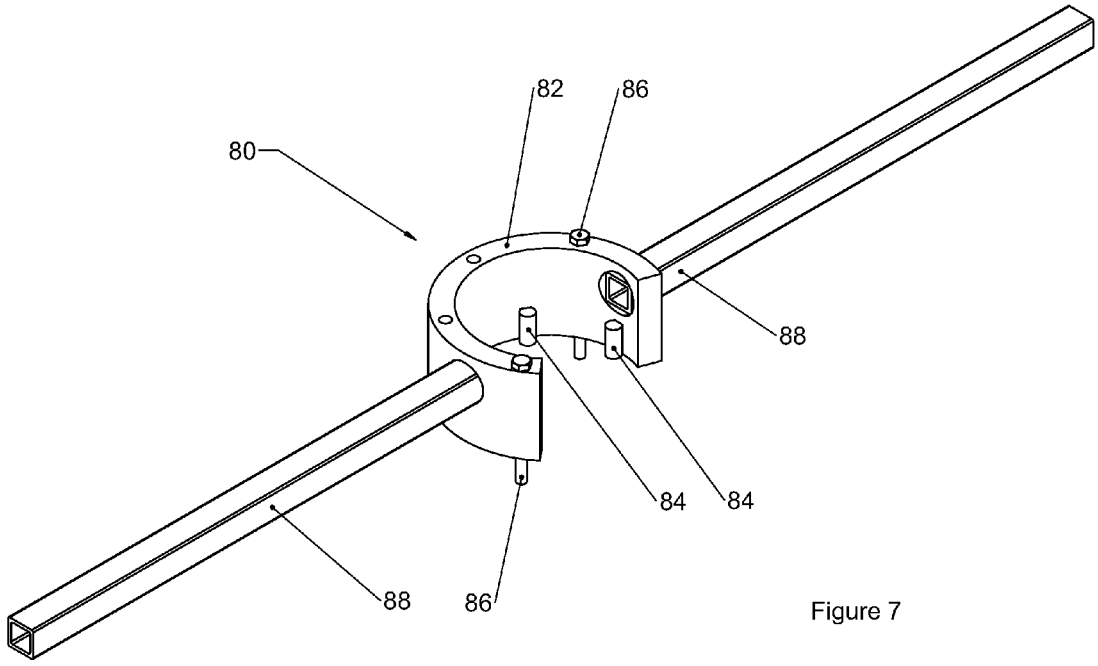
FIG. 7 is an isometric view of a J-mechanism latching tool.

FIG. 7 depicts a suitable tool 80 to aid in component manipulation when latching the J-lock mechanisms 45 particularly when rotating the inner mandrel 34 and the tubing string is not desired. Again, the rotator 16 and flange 18 have been removed. C-ring member 82 includes a plurality of pins 84 each welded or otherwise affixed to the interior of the C-ring. These pins each fit within a respective gravity 66 as shown in FIG. 6, thereby rotatably connecting the C-ring to the bushing. A pair of bolts 86 extend axially through the C-ring 82 and replace the bolts 70 to secure the C-ring to the bushing. A pair of handles 88 extends from the C-ring and are used to rotate the bushing relative to the tubing string. Manipulation of the J-lock mechanism 45 may thus be achieved without rotating the tubing string.

Using the surface equipment disclosed herein, the tubing string may be manipulated by rotation, axial pull, or set-down weight, to set an anchor at the lower end of the tubing string. With the tubing rotator 16 and flange 18 removed, a conventional pup joint may be threaded to engage the threads 38 on the inner mandrel 34, and the tubing string then tensioned using conventional surface equipment until a desired overtension is reached in the string, so that the partial release of tension during the process of rotating the bushing 32 relative to the mandrel 34 and then set down weight may be used to engage the pins in the respective "short stroke" portion of the J-lock 56, as shown in FIG. 6. A substantial amount of tension may thus be obtained, and the J-lock mechanism locks that tension in the tubing string. Once tensioned at the desired level, the flange 18 and rotator 16 may be installed, and the rotator 16 activated to rotate the tensioned tubing string. When locking and unlocking the J-lock mechanisms, the locking fitting 62 fixes rotation of the bushing, allowing the inner mandrel 34 to slide to its final locked position. In another embodiment, the rotator 16 and flange 20 may remain in place on the tubing head, and the bore of the rotator may be sufficiently large to receive the pup joint that threads for engagement with thread 38. A pup joint may not be passed though the rotator to thread with mandrel 34 and thereby tension the tubing string.

It should be apparent that the present invention allows for tubing tensioning after the tubing string is anchored, and the tensioned tubing then rotated by a tubing rotator. In a reverse operation, tension may be released to remove the anchor. By supporting the hanger on the tubing head rather than the rotator, the rotator may be replaced without pulling the tubing string. The present invention also allows full access to the tubing string, and allows the tubing string to be set with various types of anchors which requires push/pull or rotational operations of the tubing string.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. An apparatus for supporting a rotatable tubing string in a well and tensioning the tubing string, comprising:

a tubing head positioned at the surface of the well, the tubing head having at least one side port therein;

an inner mandrel positioned at least partially within the tubing head and supporting the tubing string;

a bushing supported on the tubing head and engaging the mandrel, the bushing and the inner mandrel being rotatable together relative to the tubing head;

a tubing rotator for rotating the bushing, the tubing rotator having a rotator mandrel rotatably connected to the bushing, and the tubing rotator being removable from the bushing and the tubing head while the bushing supports the tubing string; and a plurality of circumferentially spaced pin-slot mechanisms acting between the bushing and the inner mandrel for maintaining tension in the tubing string.

2. An apparatus as defined in claim 1, further comprising:

a plurality of set screws each locking a pin of a pin-slot mechanism to the bushing.

3. An apparatus as defined in claim 1, further comprising:

a non-rotatable outer head mandrel supported on the tubing head;

the bushing supported on the outer head mandrel; and a thrust bearing acting between the outer head mandrel and the bushing.

4. An apparatus as defined in claim 3, wherein the pin-slot mechanisms comprise:

a plurality of J-shaped slots within the inner mandrel; and a plurality of J-pins secured to the outer head mandrel.

5. An apparatus as defined in claim 3, further comprising;

a first seal acting between the tubing string and the bushing;

a second seal acting between the bushing and the outer head mandrel; and a third seal acting between the outer head mandrel and the inner mandrel.

6. An apparatus as defined in claim 1, wherein the bushing is rotatably connected to the tubing rotator mandrel by a non-cylindrical outer surface on the rotator mandrel engaging an inner non-cylindrical surface on the bushing.

7. An apparatus as defined in claim 1, wherein the inner mandrel includes radially inner threads at its upper end for engaging with a tubular to tension the tubing string.

8. An apparatus as defined in claim 1, wherein the plurality of circumferentially spaced pin-slot mechanisms includes at least six circumferentially spaced slots and corresponding pins.

9. An apparatus for supporting a rotatable tubing string in a well and tensioning the tubing string, comprising:

a tubing head positioned at the surface of the well, the tubing head having at least one side port therein;

an inner mandrel positioned at least partially within the tubing head and supporting the tubing string;

a non-rotatable outer head mandrel supported on the tubing head;

a bushing supported on the outer head mandrel and engaging the mandrel, the bushing and the inner mandrel being rotatable together relative to the tubing head;

a tubing rotator for rotating the bushing, the tubing rotator having a rotator mandrel rotatably connected to the bushing, and the tubing rotator being removable from the bushing and the tubing head while the bushing supports the tubing string, wherein the bushing is rotatably connected to the tubing rotator mandrel by a non-cylindrical outer surface on the rotator mandrel engaging an inner non-cylindrical surface on the bushing; and one or more tensioning mechanisms acting between the bushing and the inner mandrel for maintaining tension in the tubing string.

10. An apparatus as defined in claim 9, further comprising:

a first seal acting between the tubing string and the bushing;

a second seal acting between the bushing and the outer head mandrel; and a third seal acting between the outer head mandrel and the inner mandrel.

11. An apparatus as defined in claim 9, wherein the inner mandrel includes radially inner threads at its upper end for engaging with a tubular to tension the tubing string.

12. An apparatus as defined in claim 9, wherein the one or more tensioning mechanisms includes at least six circumferentially spaced slots and corresponding pins.

13. An apparatus as defined in claim 9, wherein the one or more tensioning mechanisms includes a clamp secured to the inner mandrel and supported on the bushing.

14. An apparatus as defined in claim 9, further comprising:

a removable locking member for rotatably connecting to the bushing and the outer head mandrel.

15. An apparatus as defined in claim 9, further comprising:

a thrust bearing acting between the outer head mandrel and the bushing.

16. A method of supporting a rotatable tubing string in a well and tensioning the tubing string, comprising:

positioning a tubing head at the surface of the well, the tubing head having at least one side port therein;

positioning an inner mandrel at least partially within the tubing head and supporting the tubing string;

supporting a bushing supported on the tubing head while engaging the inner mandrel, the bushing and the inner mandrel being rotatable together relative to the tubing head;

rotatably connecting the bushing to the tubing rotator mandrel by a non-cylindrical outer surface on the rotator mandrel engaging an inner non-cylindrical surface on the bushing;

rotating the bushing with a tubing rotator having a rotator mandrel rotatably connected to the bushing, and the tubing rotator being removable from the bushing and the tubing head while the bushing supports the tubing string; and providing one or more tensioning mechanisms acting between the bushing and the inner mandrel for maintaining tension in the tubing string.

17. A method as defined in claim 16, further comprising:

supporting a non-rotatable outer head mandrel on the tubing head;

supporting the bushing on the outer head mandrel; and providing a plurality of thrust bearings acting between the outer head mandrel and the bushing.

18. A method as defined in claim 17, wherein providing the one or more tensioning mechanisms comprise:

providing a plurality of J-shaped slots within the inner mandrel; and providing a plurality of J-pins secured to the outer head mandrel.

19. A method as defined in claim 16, further comprising;

providing a first seal acting between the tubing string and the bushing;

providing a second seal acting between the bushing and the outer head mandrel; and providing a third seal acting between the outer head mandrel and the inner mandrel.

* * * * *